US007654062B2

(12) United States Patent
Mueller et al.

(10) Patent No.: US 7,654,062 B2
(45) Date of Patent: Feb. 2, 2010

(54) PACKAGING MACHINE FOR INSERTING AN ARTICLE TO BE PACKAGED INTO A PACKAGE

(75) Inventors: Peter Mueller, Mutlangen (DE); Ulrich Wieduwilt, Schwaebisch Gmuend (DE); Armin Rupietta, Fichtenberg (DE)

(73) Assignee: Robert Bosch GmbH, Stuttgart (DE)

( * ) Notice: Subject to any disclaimer, the term of this patent is extended or adjusted under 35 U.S.C. 154(b) by 141 days.

(21) Appl. No.: 11/908,235

(22) PCT Filed: Feb. 13, 2006

(86) PCT No.: PCT/EP2006/050867

§ 371 (c)(1),
(2), (4) Date: Sep. 10, 2007

(87) PCT Pub. No.: WO2006/106007

PCT Pub. Date: Oct. 12, 2006

(65) Prior Publication Data

US 2008/0184669 A1 Aug. 7, 2008

(30) Foreign Application Priority Data

Apr. 8, 2005 (DE) ..... 10 2005 016 123

(51) Int. Cl.
*B65B 5/04* (2006.01)
*B65B 7/26* (2006.01)

(52) U.S. Cl. ..... 53/251; 53/387.2

(58) Field of Classification Search ..... 53/249, 53/250, 251, 252, 255, 262, 173, 235, 387.1, 53/387.2
See application file for complete search history.

(56) References Cited

U.S. PATENT DOCUMENTS

| | | | | |
|---|---|---|---|---|
| 2,285,283 | A * | 6/1942 | Jones | 53/56 |
| 2,662,355 | A | 12/1953 | Ross | |
| 2,663,501 | A | 12/1953 | Brummerhoff | |
| 3,290,841 | A * | 12/1966 | Sartore | 53/258 |
| 3,338,009 | A * | 8/1967 | Stevens | 53/245 |
| 3,821,874 | A * | 7/1974 | Jones | 53/449 |
| 4,187,273 | A | 2/1980 | Stratis | |
| 4,215,520 | A * | 8/1980 | Heinzer et al. | 53/173 |
| 4,554,777 | A | 11/1985 | Denk et al. | |
| 4,759,167 | A * | 7/1988 | Langen et al. | 53/142 |
| 4,982,556 | A * | 1/1991 | Tisma | 53/506 |

(Continued)

FOREIGN PATENT DOCUMENTS

| | | |
|---|---|---|
| DE | 1 586 057 | 4/1970 |

(Continued)

*Primary Examiner*—Paul R Durand
(74) *Attorney, Agent, or Firm*—Ronald E. Greigg

(57) ABSTRACT

The invention relates to a packaging machine for inserting articles which are prepackaged in bags, into folding boxes in an insertion area. The bags can be inserted via an opening cross-section of the box which is able to be at least partially covered by an essentially flat top flap. A device having a receiving area for a top flap of a box is provided in the insertion area. The top flap is, in the insertion area, positioned in the receiving area and is kept in a convex shape so that, at least during the insertion of the bag and of the box when the top flap is convexly shaped, the opening cross-section of the box is larger than when the top flap is flat.

20 Claims, 6 Drawing Sheets

U.S. PATENT DOCUMENTS 5,175,976 A * 1/1993 Petry et al. ..... 53/252
5,323,587 A * 6/1994 Amaranti ..... 53/155
5,430,990 A * 7/1995 Long ..... 53/252
5,457,941 A * 10/1995 Long et al. ..... 53/460
5,481,848 A * 1/1996 Tagliaferri et al. ..... 53/157
5,575,315 A * 11/1996 Wengert ..... 141/109
5,588,282 A * 12/1996 Hartness ..... 53/473
5,771,658 A * 6/1998 Olson et al. ..... 53/157
5,836,508 A * 11/1998 Savage ..... 229/103.3
5,896,728 A * 4/1999 Domino et al. ..... 53/458
6,041,569 A * 3/2000 Freeman et al. ..... 53/131.2
6,202,392 B1 * 3/2001 Greenwell et al. ..... 53/566
6,240,707 B1 * 6/2001 Ford et al. ..... 53/381.1
6,385,945 B1 * 5/2002 Hahnel ..... 53/377.2
6,637,174 B1 * 10/2003 Dietrich et al. ..... 53/252
6,698,163 B2 * 3/2004 Greenwell et al. ..... 53/429
6,854,244 B2 * 2/2005 Pike ..... 53/252
6,955,033 B2 * 10/2005 Lortz ..... 53/585
7,134,258 B2 * 11/2006 Kalany et al. ..... 53/473

FOREIGN PATENT DOCUMENTS

DE 93 10 969 U1 11/1994
WO WO 93/10002 A1 5/1993

* cited by examiner

PACKAGING MACHINE FOR INSERTING AN ARTICLE TO BE PACKAGED INTO A PACKAGE

CROSS-REFERENCE TO RELATED APPLICATION

This application is a 35 USC 371 application of PCT/EP 2006/050867 filed on Feb. 13, 2006.

BACKGROUND OF THE INVENTION

1. Field of the Invention

The invention relates to an improved packaging machine for inserting product to be packaged into packaging means, in particular for inserting a product packed in bags into preferably folding boxes.

The invention relates to a packaging machine for inserting product to be packaged into packaging means, in particular for inserting a product packed in bags into preferably folding boxes, as generically defined in further detail by the preamble to claim 1.

2. Description of the Prior Art

Fundamentally, a package or packaging means represents a separable wrapping of goods or a product to be packaged that makes it possible for the goods or product to be packaged, closed, and prepared for shipment. Moreover, packaging means are intended to simplify the production process in such a way that no further transfer operations occur. In addition, packaging means should also be usable as advertising media and should protect the product to be packaged against pressure, impact, moisture, and temperature; it should make storage easier; it should optimize portability and the use of space; it should make handling easier during sale; and it should assure that the package is suitably identified as to fragility, perishability, or danger, or for the sake of simpler or even automatable completion of orders.

For packaging product to be packaged, packaging machines or machines and systems are used for partially or fully automatic production of a package, for packing or dispensing certain quantities of a product, and for decoration and labeling of the package. Numerous versions of packaging machines exist; each type of machine is customized to the processing of certain packaging materials and to the use of special technologies. Depending on the material to be packaged, distinctions are made among machines for liquids, for pastelike, doughy and viscous compositions, for bulk goods, for individual parts, for solid parts, for parcels, or the like. Given the sometimes extensive work operations in the packaging system, machines suitable for the various operations are lined up in succession.

The first work step includes the fabrication and preparation of the package for receiving the goods. Bags, cups, small tubes, or the like are created from strips of paper, metal or plastic film by means of adhesive bonding, welding, and shaping. Ampules are sterilized; folding boxes are stamped out and prepared. Next, the material to be filled, or product to be packaged, is metered and introduced into the intended package. Metering in terms of the volume, mass, or number of parts is done by means of controlled valves, metering screws, weighing devices, and apportioning devices. Next, the package is closed, to suit the material filling it and the packaging material; this can be done by folding, glueing, welding, and the insertion or application of a closure in a natural atmosphere, in a vacuum, or in an inert gas environment.

A second packaging operation often follows, during which the packed goods are wrapped for instance with instructions for use and a folding box.

Particularly during the second packaging operation, the possibility exists that the product to be packaged to be introduced into the packaging means will have a larger cross section than the opening cross section of the packaging means. Especially with products such as bottles or tubes, as well as bags, that have nonhomogeneous surfaces, the height of the product to be packaged is greater than that of the packaging means, which puts undesirable restrictions on a packaging operation.

To reduce or eliminate the limitation of the packaging operation, in the industry a change has been made so that packaging means embodied as folding boxes are opened wider on a top side by means of one or more vacuum devices, so that the opening cross section of a folding box can be enlarged in a manner that improves the packaging operation.

In packaging machines that operate intermittently, opening a folding box more widely by means of vacuum devices is done while a conveyor device for furnishing packaging means is at a standstill in the area of an insertion zone, where the product to be packaged is introduced into the packaging means.

However, it is disadvantageous that the operation of widening a folding box is done before the product to be packaged is actually inserted into the opened folding box, and once the product to be packaged has been inserted, the vacuum device or devices must be detached from the folding box before the filled folding box call be transported onward in the packaging machine. This undesirably lengthens the dwell time of the folding box in the insertion zone of the packaging machine, thus lessening the throughput of the packaging machine.

If worsening of the throughput of a packaging machine is to be avoided, then a shorter packaging time is available for the insertion operation. Since during the packaging the insertion operation itself is a very time-dependent, sensitive operation, problems that are exacerbated by speeded-up procedures easily occur during this phase, and hence shortening the cycle time of the insertion operation makes the packaging machine more vulnerable to problems.

A prerequisite of widening a folding box by means of a vacuum device is a nonpositive engagement between the vacuum device and the folding box; the nonpositive engagement is affected by various factors, such as the cardboard quality, pressure drop, wear of the suction device, or dirt. However, these factors disadvantageously mean that the operation of widening a folding box cannot be performed with the same quality throughout a packaging process.

In addition, the position of a top flap of a folding box is indefinite, and if the positioning is unfavorable, it can impair both the process of inserting the product to be packaged into the folding box and the operation of widening the folding box itself. If widening and cross-sectional enlargement of a folding box by means of vacuum devices is to be feasible at all, the top flap must be located in a position that is parallel to the top side of the folding box. This is due to the fact that in positions in which the top flap, in the area of a creased edge, is pivoted relative to the surface of the folding box in such a way that the top flap and the surface of the folding box form an angle smaller than 180°, the top flap stabilizes the creased edge and hinders the desired enlargement of the opening cross section of the folding box by means of vacuum devices.

In order nevertheless to be able to perform widening of a folding box even at disadvantageous positions of the top flap, the widening operation is performed during the operation of inserting product to be packaged into the folding box; an insertion device that is located above the product to be packaged is introduced, during the insertion operation, into the folding box before the product to be packaged in order to widen the opening cross section of the folding box.

However, it is then disadvantageous that the insertion device must be in the lead, ahead of the actual insertion of the product to be packaged, and must be moved out of the folding box before the product to be packaged is inserted; this kind of procedure is therefore characterized by being highly dynamic and must be performed with extreme precision, if damage to the packaging means or to the product to be packaged is to be avoided.

Both widening by means of a vacuum and widening a folding box by lifting one side of the box from its underside have the disadvantage that during an insertion operation, a top flap is not necessarily located in a verifiable position relative to the associated surface of the folding box, so that upon disadvantageous stabilization of the creased edge during the operation of widening the folding box, impermissibly strong deformation forces may have to be exerted under some circumstances, and these can cause damage to the folding box.

The present invention therefore has the object of making a packaging machine available by means of which the aforementioned disadvantages are avoided in a simple and economical way.

SUMMARY AND ADVANTAGES OF THE INVENTION

The packaging machine of the invention for inserting product to be packaged into packaging means, in particular for inserting material packaged in bags into preferably folding boxes, is embodied with an insertion zone in which the product to be packaged is introduced into the packaging means. The product to be packaged can be inserted into the packaging means in each case via an opening cross section that is at least partially coverable by an essentially flat top flap.

In the insertion zone, a device with a receiving area for a top flap of a packaging means is provided; the top flap in the insertion zone is positioned in the receiving area in such a way and is kept in a convex shape such that the opening cross section of the packaging means, at least during the insertion of the product to be packaged into the packaging means with the top flap convexly shaped, is greater than in the flat state of the top flap, thus malting simple, problem-free introduction of product to be packaged into packaging means, such as folding boxes, possible, and the product to be packaged can be larger in cross section than the opening cross section of the packaging means.

A top flap of a packaging means is preferably guided on its upper and lower sides in the device, and as a result secure positioning of a packaging means, embodied as a folding box, and of the top flap corresponding to it is thus provided. Hence the operation of inserting product to be packaged into a packaging means is designed very securely in a simple way.

The enlarged opening cross section of the packaging means or of a folding box is related directly to a convex shape of the upper creased edge, which is established by the convex shape of the top flap; via the device, the top flap can preferably be kept in a position, relative to the top side of the packaging means, in which the top side of the packaging means and the top flap form an angle of 180° with one another, in which position a disadvantageous stabilization of the creased edge is avoided. The convex curvature of the creased edge between the top flap and the top side of the packaging means, in an advantageous refinement of the subject of the invention, can be adapted individually to any desired format and also to different degrees of filling of a packaging means.

The packaging machine of the invention furthermore offers the advantage that a packaging means, during the process of insertion of the product to be packaged into the packaging means, already has the cross-sectional enlargement requirement for the insertion operation, and the insertion operation can be performed without a time lag, or in other words without shortening the cycle time.

In the packaging machine of the invention, the opening cross section of a packaging means is enlarged in a positive-engagement way, and the procedure according to the invention is gentler to the material, compared to methods known in the industry.

The enlargement of the opening cross section of the packaging means takes place automatically and can be verified unequivocally; as a result, the widening of a packaging means in the opening area is performed within predefined tolerances, in the area of the insertion zone, each time a product passes through.

BRIEF DESCRIPTION OF THE DRAWINGS

One exemplary embodiment of the invention is described in further detail herein below, with reference to the drawings, in which.

DESCRIPTION OF THE PREFERRED EMBODIMENT

Figure 1:
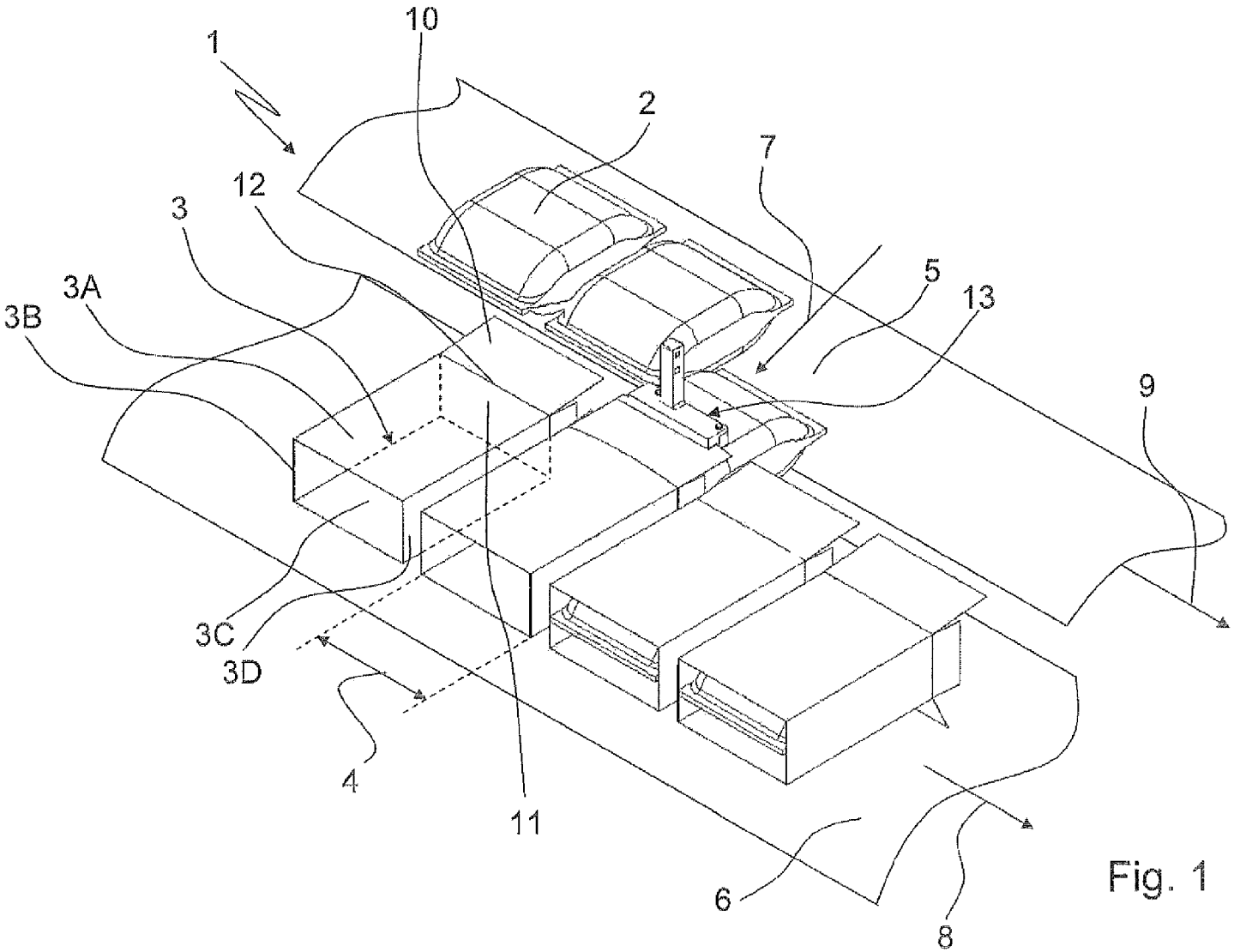
FIG. 1 is a simplified perspective view of packaging means, product to be packaged to be introduced into the packaging means, and a device according to the invention for widening the packaging means.

In FIG. 1, part of a packaging machine 1, embodied as a cardboard-box-making machine, for inserting product 2 to be packaged into packaging means 3 is shown. The product 2 to be packaged in this case is material packed in bags, which are introduced into packaging means 3, embodied as folding boxes, in an insertion zone 4 of the packaging machine 1.

The packaging machine 1 includes a first conveyor device 5 for furnishing the bags 2 in the insertion zone 4 and a second conveyor device 6 for furnishing the folding boxes 3 in the insertion zone 4, as well as an insertion device, not identified by reference numeral, for displacing the bags 2 into the folding boxes 3 in the insertion zone 4 and essentially transversely to a direction of motion of the conveyor devices 5 and 6.

The insertion direction of the bags 2 into the folding boxes 3 and the directions of motion of the conveyor devices 5 and 6 are represented graphically by the arrows in FIG. 1 identified by reference numerals 7, 8, and 9, respectively.

The product to be packaged or bags 2 can each be introduced into the folding boxes 3 via a respective rectangular opening cross section 11 of the folding boxes that can be covered at least partially by an essentially flat top flap 10; the opening cross section 11 is defined by the four sides 3A through 3D of a folding box 3.

Between the top flap 10 and the side 3A of the folding box 3, a so-called creased edge 12 is provided, which represents a jointlike area for the top flap 10 about which the top flap 10 can be pivoted relative to the side or top side 3A of the folding box 3.

In the insertion zone 4, a device 13 is provided by means of which the top flap 10, the creased edge 12, and the top side 3A of the folding box 3 can be converted, beginning at a flat form, into a convex shape and held in that shape in at least some areas in the insertion zone 4, so that the opening cross section 11 of the packaging means or of a folding box 3, during the insertion of the product 2 to be packaged into the packaging means 3, while the top flap 10 is shaped convexly, is larger than in a flat state of the top flap 10.

Figure 2:
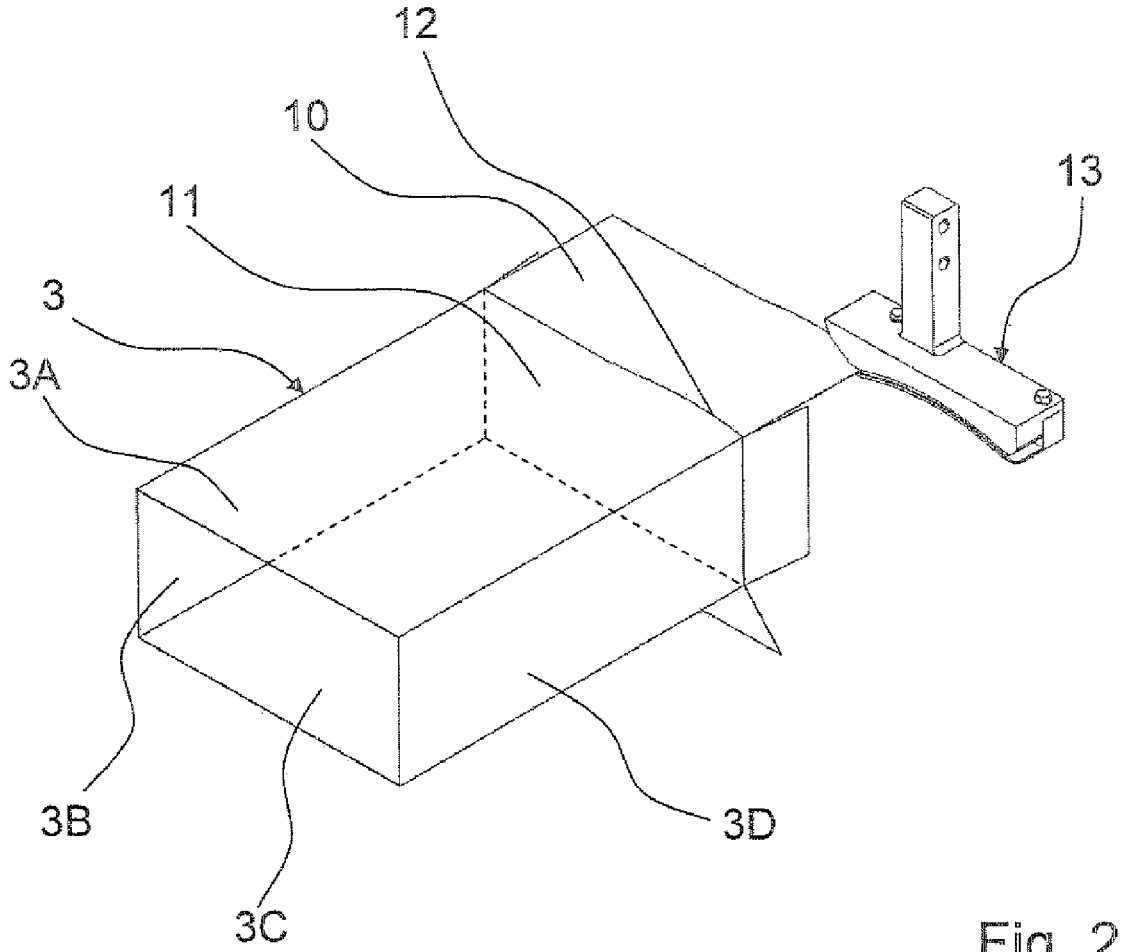
FIG. 2, a three-dimensional individual view of a packaging means and of the widening device, during a phase of introducing a top flap into a receiving area of the device.
Figure 3:
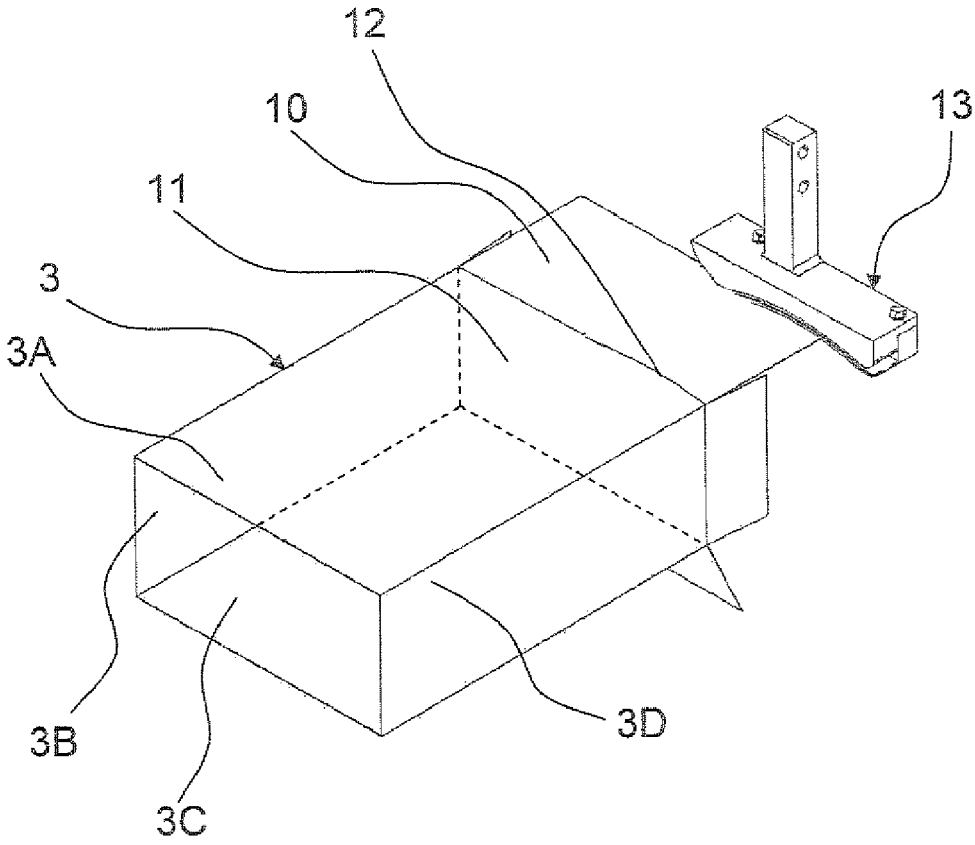
FIG. 3, a view corresponding to FIG. 2 of the packaging means and of the widening device, in which the top flap is increasingly located in the receiving area of the device.
Figure 4:
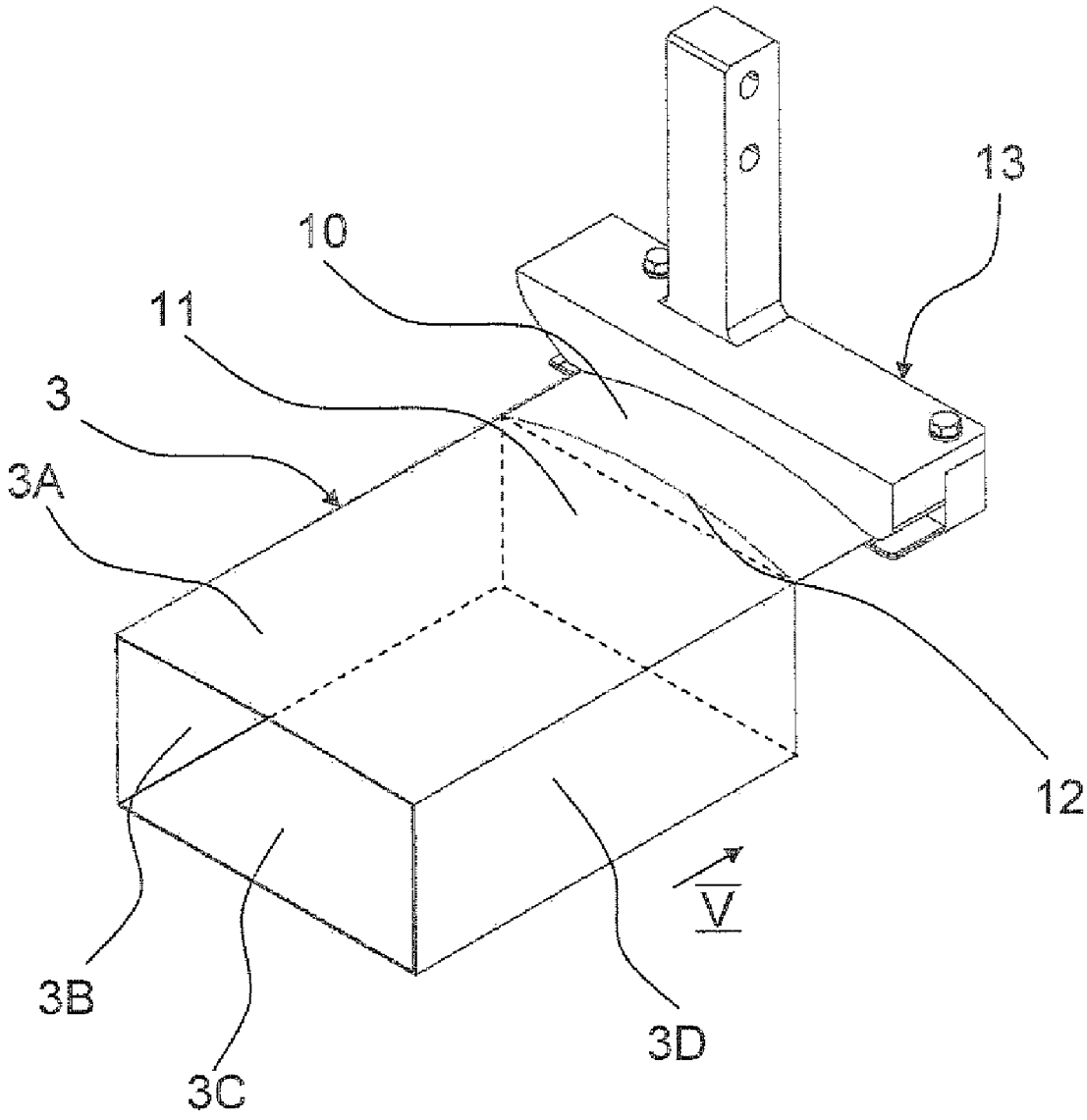
FIG. 4, a view, corresponding to FIG. 2 and FIG. 3, of the packaging means and of the widening device, in which the top flap is located over its entire width in the receiving area and is kept in a convex shape.
Figure 5:
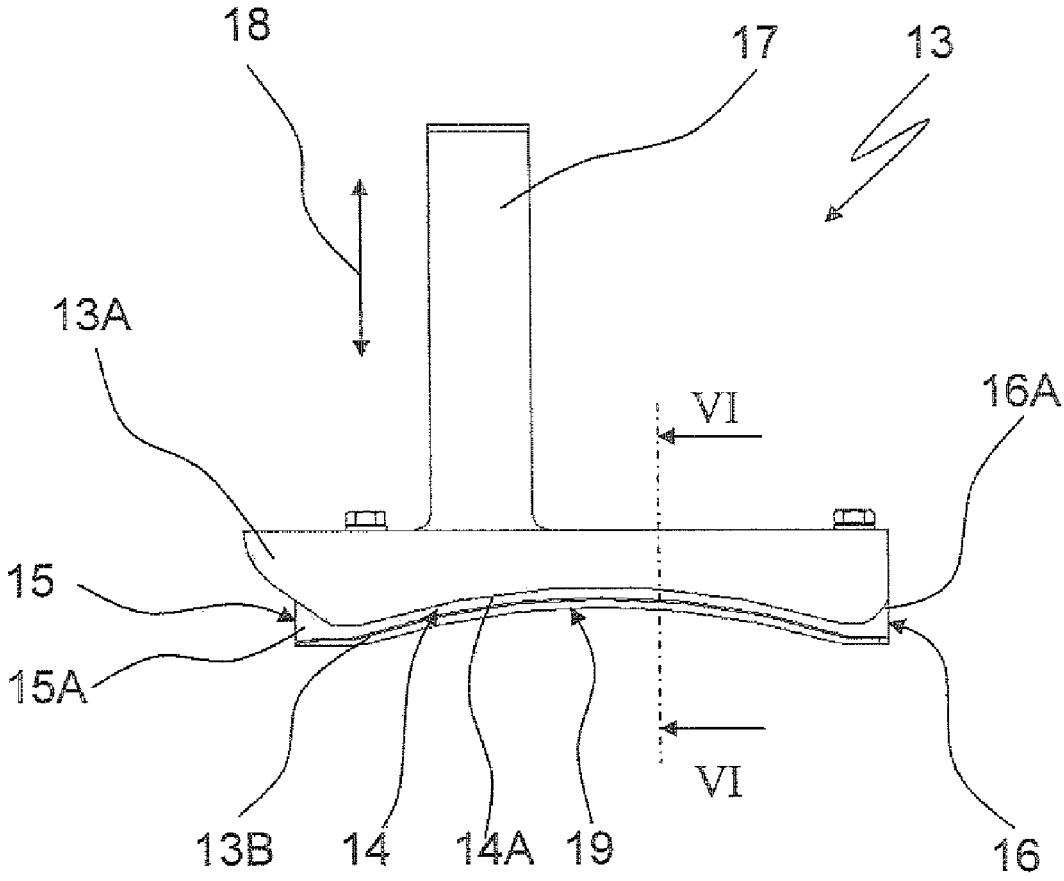
FIG. 5, a schematic side view of the widening device, seen from a direction V shown in detail in FIG. 4.

To that end, the top flap 10 is inserted, in the manner show in FIGS. 2 through 4, into a receiving area 14, shown in greater detail in FIG. 5, of the device 13, the latter being embodied as immobile relative to the insertion zone 4; in the area of the insertion zone 4, the top flap 10 is positioned in the receiving area 14 of the device 13 in such a way that the opening cross section 11 of a folding box is enlarged to the extent required for the operation of inserting the product 2 to be packaged into the folding box 3.

The receiving area 14 is embodied with an introduction area 15 for the top flap 10 that beginning at an opening area 15A tapers continuously in the direction of a guide area 14A for the top flap 10 of the receiving area 14, which has an essentially constant gap size.

The receiving area 14 is furthermore embodied with an outlet area 16 for the top flap 10 that increases in size continuously, beginning at the guide area 14A, in the direction of a further opening area 16A of the receiving area 14.

Because of the embodiment of the device 13 with the introduction area 15 and the outlet area 16, especially gentle guidance of the top flap 10 in the receiving area 14 is assured since both the introduction area 15 and the outlet area 16 are embodied in funnel-like fashion, thus simply and reliably avoiding not only skewing between the top flap 10 and the device 13 but also damaging deformation of the top flap 10 itself.

The guide area 14A of the receiving area 14 in this case is embodied as a groove, extending in the feeding direction 8 of the folding boxes 3 and embodied with a convex curvature relative to the top side 3A, toward the device, of the folding boxes 3. The receiving area 14 is furthermore defined by an upper part 13A and a lower part 13B, the latter solidly joined to the upper part via a screw connection.

In addition, the upper part 13A is embodied with a fastening element 17, by means of which the position of the device 13 in the directions represented by the double arrow 18 is made variable. Thus the position of the device 13 can be adapted to a position of the top flap 10 of the folding boxes 3, or to a height of the folding boxes 3.

In addition, the device 13, on the side toward the product to be packaged, is embodied with a convex recess 19, so that the insertion area for the product 2 to be packaged in the insertion zone 4 is not hindered or restricted by the device 13. The convex recess 19 in this case is adapted to the convex shape of the guide area 14A of the receiving area 14, and it is understood that it can deviate from that; the recess 19 should be provided in such a way that the insertion of the bags 2 into the folding boxes 3 is unhindered by the device 13.

Figure 6:
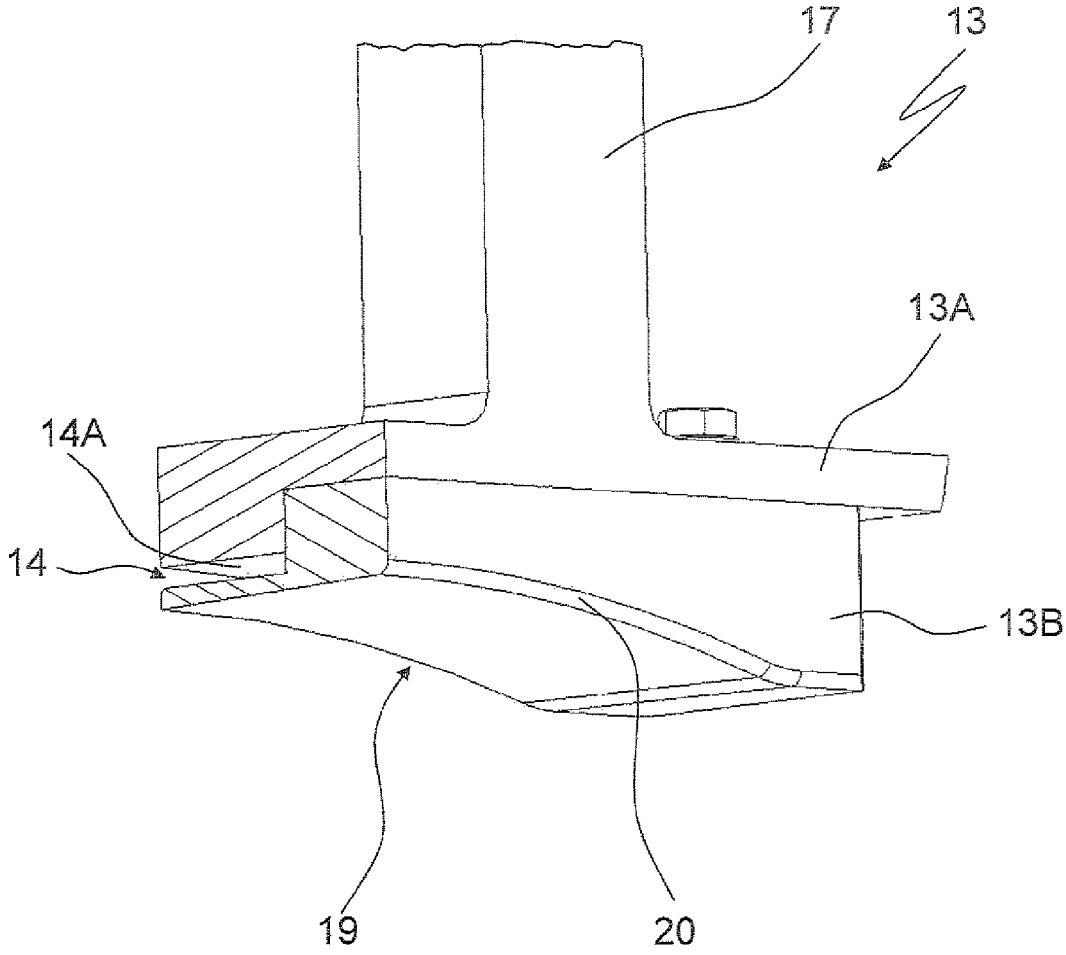
FIG. 6, a three-dimensional cross-sectional view of the widening device, taken along the line VI-VI of FIG. 5.

In FIG. 6, a three-dimensional cross-sectional view of the device 13 is shown, taken along the line VI-VI shown in FIG. 5. It can be seen from the view in FIG. 6 that the device 13, in the area of the lower part 13B, on a side toward the product to be packaged or bags 2 to be introduced into the packaging means or folding boxes 3, is embodied with an introduction bevel 20, which is disposed in the area of the convex recess 19 and is rounded in cross section, so that a bag 2 introduced into a folding box 3 as harmoniously as possible, past the device 13, and in the area of the introduction bevel 20 will not be damaged by contact with the device 13.

The packaging operation and the widening of the cross-sectional opening 11 of a folding box 3 during the packaging operation will now be described in further detail, referring to FIG. 1.

Once the folding box 3 has been placed in the second conveyor device 6, the top flap 10 is in a virtually horizontal position relative to the top side 3A of the folding box 3 and essentially forms an angle of 180° with that top side 3A. The product 2 to be packaged disposed in the first conveyor device 5 is conveyed synchronously with the folding box 3 and in such a way that it is positioned exactly relative to the folding box 3.

Next, the product 2 to be packaged in the insertion zone 4 is inserted into the folding box 3, which has been enlarged in the manner described above in terms of the cross-sectional opening by means of the device 13; during the conveyance of a folding box 3 into the insertion zone 4, the top flap 10 is introduced in the manner shown in FIGS. 2 through 4 increasingly into the receiving area 14 of the device 13 and is kept in a convex shape, until a bag 2 has been placed in the interior of a folding box 3. Next, the filled folding box 3 is moved out of the insertion zone 4, and the top flap 10 is brought back out of the receiving area 14 of the device 13, and optionally in a further packaging segment, the folding box 3 can be closed in a manner known per se.

It is understood that it is up to the judgment of one skilled in the art to embody the introduction area 15 and outlet area 16 as separate shunts, as an alternative to the version shown in the drawings, so that a top flap of a packaging means or folding box can be introduced into and guided out of the guide area 14A of the device 13 smoothly.

Furthermore, in a further embodiment, not shown, of the subject of the invention, it may be provided that the device for widening an opening cross section of a packaging means is embodied variably or deformably in the guide area in such a way that a degree of curvature of the guide area can be varied as a function of the particular application in question, to enable adapting the device to various packaging means without having to replace the device itself.

In a departure from this, however, the possibility also exists of embodying the device as a specific-format part which corresponds with only one particular format of packaging means. When packaging means formats are changing, a different device must then be installed in the area of the insertion zone of a packaging machine.

The above-described device for widening an opening cross section of a packaging means is suitable for both continuously and incrementally operated packaging machines and enables the most problem-free possible insertion of product to be packaged, including in particular nonhomogeneous products to be packaged without changing a cycle time of the insertion operation. Thus a throughput of a packaging machine of the invention, compared to conventionally embodied packaging machines, is unimpaired, while at the same time the vulnerability to problems is reduced.

The foregoing relates to a preferred exemplary embodiment of the invention, it being understood that other variants and embodiments thereof are possible within the spirit and scope of the invention, the latter being defined by the appended claims.

The invention claimed is:

1. A packaging machine for inserting product packed in bags into boxes each box having oppositely disposed side walls spaced a distance from one another and a flat top flap attached along one edge of one of said side walls, the top flap being foldable relative to said side walls to at least partly cover an open end of the box, the machine comprising:

an insertion zone in which a bag is introduced into a box though the open end of the box;

means for transporting the box in a feeding direction into the insertion zone; and means, in the insertion zone, for increasing the distance between the oppositely disposed side walls of the box during the insertion of the product to be packaged into the box, said means including a convex receiving area for reshaping the top flap into a convex shape.

2. The packaging machine as defined by claim 1, wherein the means for increasing the distance between the oppositely disposed side walls of the box includes an inlet area having a tapered groove into which an edge of the top flap is initially inserted as the box is fed into the insertion zone.

3. The packaging machine as defined by claim 2, wherein the means for increasing the distance between the oppositely disposed side walls of the box includes an outlet area having a tapered groove, the tapered grove of the outlet area, beginning at the convex receiving area, increases in size continuously in the feeding direction.

4. The packaging machine as defined by claim 3, wherein the convex receiving area is formed by a groove extending in the feeding direction and having a convex curvature with respect to an outer surface of the side wall of the box to which the top flap is attached.

5. The packaging machine as defined by claim 3, wherein the means for increasing the distance between the oppositely disposed side walls of the box is defined by an upper part and a lower part connected to the upper part.

6. The packaging machine as defined by claim 3, further comprising a fastening element by means of which the position of the means for increasing the distance between the oppositely disposed side walls of the box can be adjusted relative to the position of the top flap of the box.

7. The packaging machine as defined by claim 2, wherein the convex receiving area is formed by a groove extending in the feeding direction and having a convex curvature with respect to an outer surface of the side wall of the box to which the top flap is attached,

8. The packaging machine as defined by claim 7, further comprising a fastening element by means of which the position of the means for increasing the distance between the oppositely disposed side walls of the box can be adjusted relative to the position of the top flap of the box.

9. The packaging machine as defined by claim 2, wherein the means for increasing the distance between the oppositely disposed side walls of the box is defined by an upper part and a lower part connected to the upper part.

10. The packaging machine as defined by claim 9, wherein at least a portion of the lower part of the means for increasing the distance between the oppositely disposed side walls of the box is deformable, whereby the curvature of the convex receiving area is adjustable.

11. The packaging machine as defined by claim 2, further comprising a fastening element by means of which the position of the means for increasing the distance between the oppositely disposed side walls of the box can be adjusted relative to the position of the top flap of the box.

12. The packaging machine as defined by claim 2, wherein the means for increasing the distance between the oppositely disposed side walls of the box is formed with a bevel on a side oriented towards the bags to be introduced into the boxes.

13. The packaging machine as defined by claim 12, wherein the means for increasing the distance between the oppositely disposed side walls of the box includes a convex recess facing the bags as the bags are introduced into the boxes, and the bevel is disposed in the area of the recess and is rounded in cross section.

14. The packaging machine as defined by claim 1, wherein the means for increasing the distance between the oppositely disposed side walls of the box is defined by aw upper part and a lower part connected to the upper part.

15. The packaging machine as defined by claim 14, wherein the means for increasing the distance between the oppositely disposed side walls of the box is formed with a bevel on a side oriented towards the bags to be introduced into the boxes.

16. The packaging machine as defined by claim 14, wherein at least a portion of the lower part of the means for increasing the distance between the oppositely disposed side walls of the box is deformable, whereby the curvature of the convex receiving area is adjustable.

17. The packaging machine as defined by claim 1, further comprising a fastening element by means of which the position of the means for increasing the distance between the oppositely disposed side wails of the box can be adjusted relative to the position of the top flap of the box.

18. The packaging machine as defined by claim 1, wherein the means for increasing the distance between the oppositely disposed side walls of the box is formed with a bevel on a side oriented towards the bags to be introduced into the boxes.

19. The packaging machine as defined by claim 18, wherein the means for increasing the distance between the oppositely disposed side wails of the box includes a convex recess facing the bags as the bags are introduced into the boxes, and the bevel is disposed in the area of the recess and is rounded in cross section.

20. The packaging machine as defined by claim 1, wherein the packaging machine is operable discontinuously or continuously.

* * * * *